US006330846B1

(12) United States Patent
Strauch

(10) Patent No.: US 6,330,846 B1
(45) Date of Patent: Dec. 18, 2001

(54) CHUCK FOR BITS OR THE LIKE

(75) Inventor: Martin Strauch, Wuppertal (DE)

(73) Assignee: Wera Werk Hermann Werner GmbH & Co., Wuppertal (DE)

( * ) Notice: Subject to any disclaimer, the term of this patent is extended or adjusted under 35 U.S.C. 154(b) by 0 days.

(21) Appl. No.: 09/483,850

(22) Filed: May 16, 2000

(30) Foreign Application Priority Data

Jan. 18, 1999 (DE) ..... 199 01 662

(51) Int. Cl.[7] ..... B25B 23/159
(52) U.S. Cl. ..... 81/477; 81/467; 81/480
(58) Field of Search ..... 81/477, 480, 467

(56) References Cited

U.S. PATENT DOCUMENTS 3,744,350 7/1973 Raff .
4,063,474 * 12/1977 Klopping .
4,249,435 * 2/1981 Villeneuve et al. .
5,735,183 * 4/1998 Sasaki et al. .
6,076,439 * 6/2000 Dzieman .

FOREIGN PATENT DOCUMENTS 4143218 9/1992 (DE) .
19722776 2/1997 (DE) .
19804081 12/1998 (DE) .

* cited by examiner

*Primary Examiner*—Timothy V. Eley
*Assistant Examiner*—Willie Berry, Jr.
(74) *Attorney, Agent, or Firm*—Martin A. Farber

(57) ABSTRACT

A invention relates to a chuck having a shank which provides two shank sections (5, 6), forms a clamping section (1) at one end for clamping in place in a drive member and forms a tool mounting (2) at the other end for mounting a tool, in particular a screwdriver bit (18), having an elastic element between the clamping-side shank section (6) and the tool-mounting-side shank section (5) for permitting a stop-limited twisting capability of the clamping section relative to the tool mounting (2). To achieve a narrow type of construction, provision is made for the elastic element to be formed as a bending spring which is bendable transversely to the axis of the chuck and connects the two shank sections to one another.

13 Claims, 2 Drawing Sheets

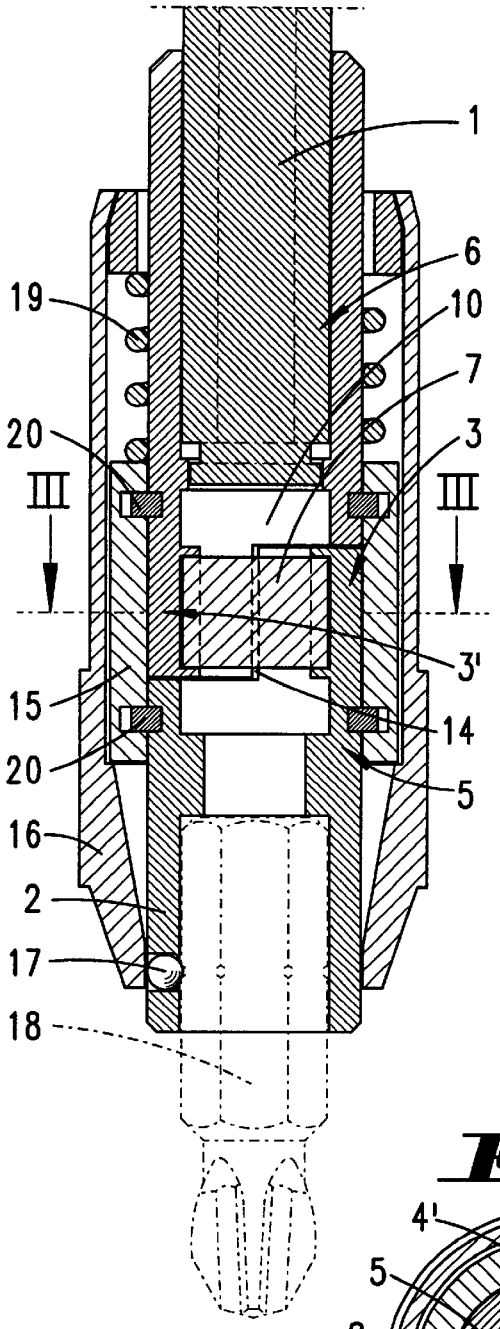
Fig. 2
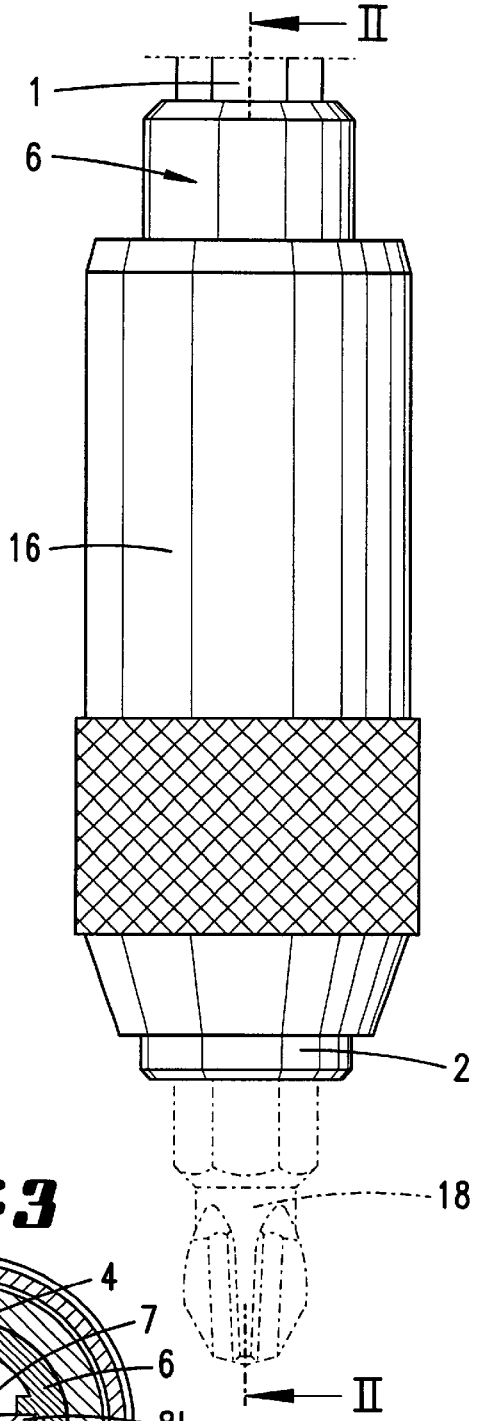
Fig. 1
Fig. 3
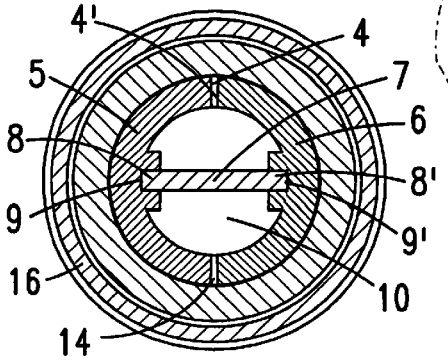

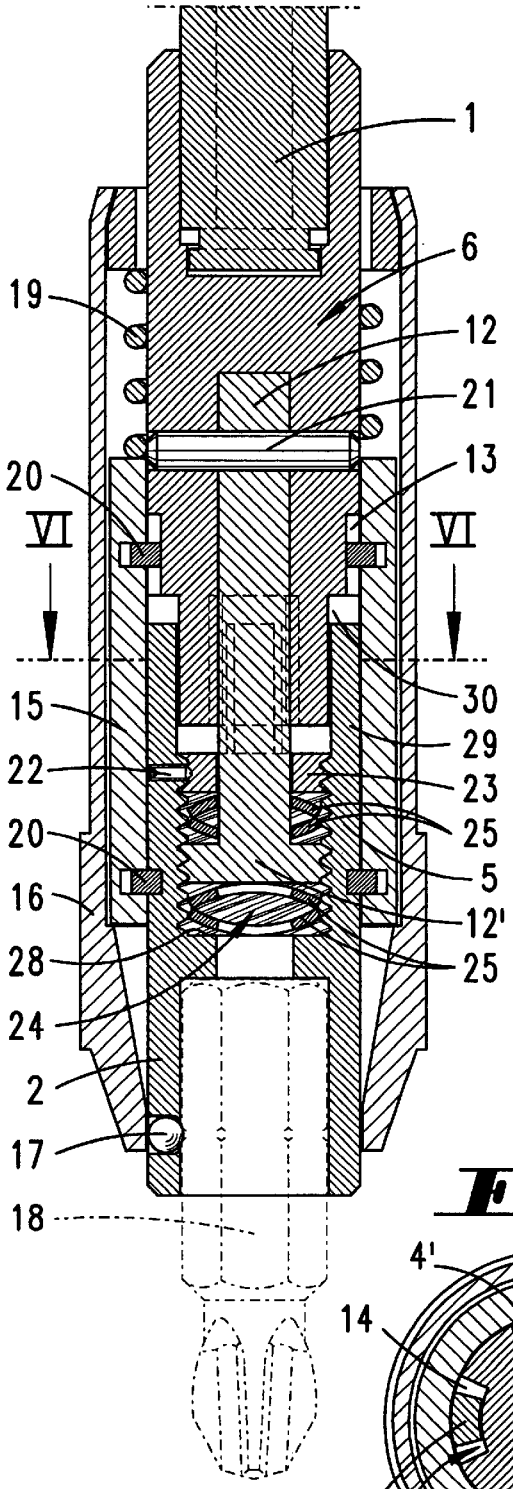
Fig. 5
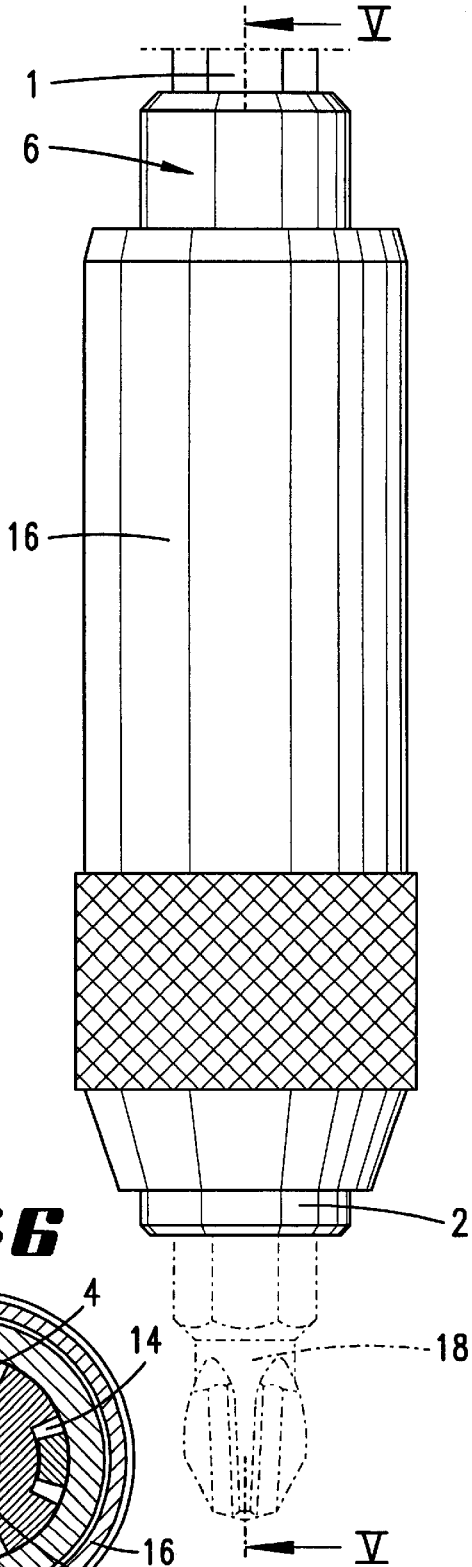
Fig. 4
Fig. 6
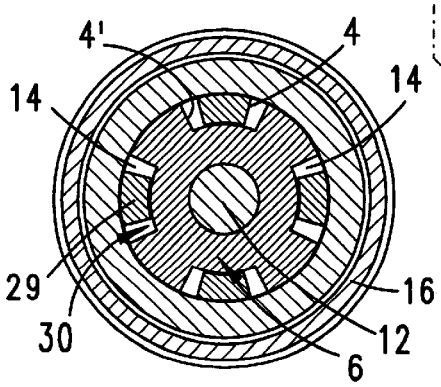

CHUCK FOR BITS OR THE LIKE

FIELD AND BACKGROUND OF THE INVENTION

The invention relates to a chuck having a shank which provides two shank sections, forms a clamping section at one end for clamping in place in a drive member and forms a tool mounting at the other end for mounting a tool, in particular a screwdriver bit, having an elastic element between the clamping-side shank section and the tool-mounting-side shank section for permitting a stop-limited twisting capability of the clamping section relative to the tool mounting.

Such a chuck, which in particular can be clamped in place with its clamping section in an electric screwdriver, has been previously disclosed by U.S. Pat. No. 3,744,350. This publication discloses a multiplicity of elastic elements of different formation, these elastic elements acting between the two shank sections.

DE-A 197 22 776.7 and DE-A 198 04 081.4, likewise describe chucks of the type in question. The solutions described there are distinguished by the fact that the elastic element is formed as a torsion element, having a cylindrical torsion section lying between its two ends, the ends being connected substantially free of play in each case to one of the two shank sections. The solution described there permits a narrow type of construction.

SUMMARY OF THE INVENTION

The object of the invention is to provide a chuck of the introductory-mentioned type which can be produced in a narrow type of construction.

This object is achieved first and foremost by the elastic element being formed as a bending spring which is bendable transversely to the axis of the chuck and connects the two shank sections to one another. In this case, the bending spring is seated in a cavity, which is defined by half-shell sections, running parallel to one another, of the shank sections. The half-shell sections are separated from one another by a gap extending in the axial direction. Gap edges of this gap define stop edges. The two stop edges defined by the gap come into contact if the spring is bent transversely to the axis of the chuck when applying a certain torque. Bendability is possible in both the anticlockwise and clockwise directions. In an advantageous manner, the two restraining edges, extending in the axial direction, of the substantially rectangular bending spring are each seated in a groove, which is associated with the hollow inner wall of one of the two half-shells.

Furthermore, the object underlying the invention is achieved by a screw-thread-guided axial spring biassing of the two shank sections. The elastic element can likewise be accommodated in a cavity of one of the shank sections. One of the two shank sections preferably has a captive section, which is spring-biassed in both axial directions relative to the other shank section. In this case, the captive section may be the widened end of a ram, which is fixedly connected to one of the two shank sections. The captive section may have an external thread. This external thread may be screwed into a tapped hole of the other shank section. Screw thread guidance is achieved with simple means as a result of this thread guidance. However, it is also possible for one of the two shank sections to provide a pin which projects radially outwards and engages in a screw thread slot of the other shank section in order to thus form screw thread guidance. The screw thread guidance lies within the range outside self-locking, so that return biassing/return rotation is ensured. The ram is preferably spring-biassed on either side. The springs may be formed by compression springs and in particular by disc springs. One spring may be supported on the base of the tapped hole. The other spring may be supported against a pressure portion screwed into the opening of the tapped hole. The two spring packages may be compressed by screwing in the pressure portion. Preloading can therefore be provided. The pressure portion may be secured against rotation, for example, by split pin or grub screw.

The stops may in principle be configured as desired. For example, it is conceivable, in the version with axial spring biassing, to provide the stops by abutment surfaces engaging one another in the axial direction. Preferred, however, is a configuration is such that the two separating grooves intermesh in a comb-like manner. In this case, the stops are defined by a comb-like section of the separating groove. At the same time, the intermeshing shank sections define a gap between them which extends in the axial direction. Furthermore, it is advantageous if the separating groove is covered by a sleeve.

The solution according to the invention permits stop-limited torsion of the clamping-side shank section relative to the shank section forming the tool mounting. An elastic yielding capability is possible in both the anticlockwise and clockwise directions. There is movement play on both sides. During the movement of the two shank sections relative to one another, either the bending spring is bent or one of the two compression springs is compressed. Up to an initial limit torque, the chuck behaves like a virtually rigid body. The initial limit torque is defined by the dimensioning of the bending spring or of the compression springs and their pretreatment. In addition, this limit torque is also defined by the preloading of the compression springs. If the initial limit torque is exceeded, the elastic element yields, in the course of which the two shank sections twist relative to one another until the two stops abut against one another. Between the two limit torques, the two shank sections can rotate relative to one another by the movement play. As soon as the stops abut against one another, the chuck again acts as a virtually rigid body. With regard to the mode of operation, for the reference is made to the entire disclosure content, which is hereby incorporated herein, of DE-A 197 22 776.7 and DE-A 198 04 081.4.

BRIEF DESCRIPTION OF THE DRAWING

The subject matter of the invention is explained in more detail below with reference to two exemplary embodiments illustrated in the drawings, in which:

FIG. 1 shows a chuck according to the invention of a first exemplary embodiment in elevation;

FIG. 2 shows a section along line II—II in FIG. 1;

FIG. 3 shows a section along line III—III in FIG. 2;

FIG. 4 shows a chuck according to the invention of a second exemplary embodiment in elevation;

FIG. 5 shows a section along line V—V in FIG. 4; and

FIG. 6 shows a section along line VI—VI in FIG. 5.

DETAILED DESCRIPTION OF THE PREFERRED EMBODIMENT

The chuck according to the first exemplary embodiment, shown in FIGS. 1 to 3, has a polygonal, in particular hexagonal, clamping section 1, by means of which the chuck can be clamped in position in a drive member, for example a drilling machine. The end of the clamping section, secured in both the radial and axial directions, is seated in a positive-locking manner in one end of the clamping-side shank section 6. The other end of the shank section 6 is formed as a half-shell section 3. Parallel thereto, one end of the adjoining tool-mounting-side shank section 5 likewise forms a half-shell section 3'. The half-shell sections are each formed by an axially sectioned cylindrical tube section.

The two half-shell sections 3, 3' define a gap 14 between them which runs in the axial direction and defines stop edges 4, 4'.

In the cavity 10 defined by the two half-shell sections 3, 3', a bending spring 7 formed to be of substantially rectangular shape is seated parallel to the axial plane.

The other end of the shank section 5 has a tool 5 mounting 2, which has a polygonal profile, in particular a hexagonal profile, for the insertion of a bit 18. At its polygonal section, the bit 18 has corner recesses into which a ball 17 presses in order to hold the bit 18 in a captive position in the tool carrier 2. The ball 17 can be displaced into a release position by displacement of an actuating sleeve 16. The actuation of the actuating sleeve 16 is effected by axial displacement of the same against the pressure of a spring 19. The actuating sleeve 16 covers a sleeve 15, which in turn covers the region of the half-shell sections 3, 3' of the shank sections 5, 6. The sleeve 15 is connected to the two shank sections via retaining rings 20. Thus the two shank sections 5, 6 are held captive axially relative to one another, but may rotate relative to one another by the angular amount predefined by the width of the gap 14.

The two restraining edges 8, 8' of the bending spring 7 are each pressed into a groove 9, 9', which in each case is provided by one of the two half-shell sections 3, 3'.

In order to be able to rotate the two shank sections 5, 6 relative to one another, a certain limit torque, which is determined by the hardness profile or the pretreatment of the bending spring 7, must be exceeded. Until the limit torque is reached, the chuck behaves substantially like a virtually rigid body. When the limit torque is exceeded, the torsion of the chuck starts, the two shank sections 5, 6 being rotated relative to one another and the bending spring 7 deflecting transversely to the axis of the chuck. If the two shank sections 5, 6 are now rotated further relative to one another, the stop edges 4,4' of the two half-shell sections 3, 3' abut against one another, so that there is direct torque driving of the two shank sections 5, 6. Thus the torsion of the chuck comes to an end, and the chuck now behaves again like a virtually rigid body.

The second exemplary embodiment of the chuck, shown in FIGS. 4 to 6, resembles the first exemplary embodiment in form and function.

Here, the two shank sections 5, 6 are connected to one another by a screw-thread-guided axial spring mounting, but are disposed at a horizontal spacing from one another. At its clamping-side end, the tool-mounting-side shank section 5 has a tapped hole 24, which extends in the axial direction. Located screwed into the tapped hole 24 is a captive section, which is the widened end 12' of a ram 12, which has an external thread 26. The ram 12 is spring-biassed on either side by one pair each of suitable preloaded compression springs 25, the springs 25 being supported on the one hand on the base 28 of the tapped hole 24 and on the other hand on a pressure portion 23 screwed into the opening of the tapped hole 24. The pressure portion 23 is locked in a rotationally fixed manner in the tapped hole 24 by a grub screw 22 or a headless set screw.

The other end of the ram 12 is a cylindrical rod, which is accommodated by a bore at the tool-mounting-side end of the shank section 6 and is secured there in both the axial and radial directions by means of a cylindrical pin 21.

At its clamping-side end, the tool-mounting-side shank section 5 provides four fingers 29 formed to be annular-segment-shaped, which engage in the manner of a comb in recesses 30 formed to be annular-segment-shaped at the tool-mounting-side end of the clamping-side shank section 6. The recesses 30 are formed so as to be wider than the fingers 29 and thus each leave a separating groove 14 on either side of the fingers. The edges of the separating grooves 14 define stop edges 4, 4' of the intermeshing shank sections 5, 6. The region of the separating grooves 14 is covered by a sleeve 15, which is connected to the two shank sections 5, 6 by retaining rings 20.

The shank section 6 has a wide annular groove in the region of the retaining rings 20, so that the shank section 6 remains movable in the axial direction.

The second exemplary embodiment of the chuck behaves like the first exemplary embodiment as a virtually rigid body until the initial limit torque is reached. If the initial limit torque is exceeded, the two shank sections 5, 6 start to rotate relative to one another. In the process, the wide end 12' of the ram 12 held in the shank section 6 in a positive-locking manner is screwed against the pressure of the springs 25 further into the tapped hole 24—or, depending on the direction of rotation, is screwed out further—until the stop edges 4, 4' of the two shank sections 5, 6 abut against one another.

In order to permit the movement, produced by the thread, in the axial direction, the two shank sections 5, 6 are disposed at a horizontal spacing from one another.

What is claimed is:

1. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), wherein the elastic element is formed as a bending spring which is bendable transversely to the axis of the chuck and connects the two shank sections to one another, wherein the bending spring is seated in a cavity which is defined by half-shell sections of the shank sections, said half-shell sections running parallel to one another.

2. Chuck according to claim 1, wherein the half-shell sections define a gap therebetween which extends in axial direction and defines stop edges.

3. Chuck according to claim 1, wherein both restraining edges of the bending spring are each seated in a groove, which respectively is provided by one of the two half-shell sections.

4. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), and a screw-thread-guided axial spring biasing of the two shank sections (5, 6), wherein one shank section is formed as a captive section, which is spring-biased in both axial directions relative to the other shank section, wherein the captive section is a widened end of a ram.

5. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), and a screw-thread-guided axial spring biasing of the two shank sections (5, 6), wherein one shank section is formed as a captive section, which is spring-biased in both axial directions relative to the other shank section, wherein the captive section has an external thread, by which it is screwed into a tapped hole of the other shank section.

6. Chuck according to claim 5, wherein springs mounting a plunger on either side are supported, in particular in a preloaded manner, on one hand on a base of the tapped hole and on an other hand on a distance portion screwed into the opening.

7. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), and a screw-thread-guided axial spring biasing of the two shank sections (5, 6), wherein stops are defined by a section of a separating groove between the two shank sections (5, 6), intermeshing shank sections having a gap therebetween which extends in axial direction.

8. Chuck according to claim 7, wherein the separating groove is covered by a sleeve.

9. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), wherein the elastic element is formed as a bending spring which is bendable transversely to the axis of the chuck and connects the two shank sections to one another, wherein one shank section is formed as a captive section, which is spring-biased in both axial directions relative to the other shank section, wherein the captive section is a widened end of a ram.

10. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), wherein the elastic element is formed as a bending spring which is bendable transversely to the axis of the chuck and connects the two shank sections to one another, wherein one shank section is formed as a captive section, which is spring-biased in both axial directions relative to the other shank section, wherein the captive section has an external thread, by which it is screwed into a tapped hole of the other shank section.

11. Chuck according to claim 10, wherein springs mounting a plunger on either side are supported, in particular in a preloaded manner, on one hand on a base of the tapped hole and on an other hand on a distance portion screwed into the opening.

12. Chuck comprising a shank which provides two shank sections (5, 6), forms a clamping section (1) at one end for clamping in place in a drive member and forms a tool mounting (2) at the other end for mounting a tool, in particular a screwdriver bit (18), an elastic element between the clamping-side shank section (6) and the tool-mounting-side shank section (5) for permitting a stop-limited twisting capability of the clamping section relative to the tool mounting (2), wherein the elastic element is formed as a bending spring which is bendable transversely to the axis of the chuck and connects the two shank sections to one another, wherein stops are defined by a section of a separating groove between the two shank sections (5, 6), the intermeshing shank sections having a gap therebetween which extends in axial direction.

13. Chuck according to claim 12, wherein the separating groove is covered by a sleeve.

* * * * *

UNITED STATES PATENT AND TRADEMARK OFFICE

CERTIFICATE OF CORRECTION

PATENT NO. : 6,330,846 B1
DATED : December 18, 2001
INVENTOR(S) : Martin Strauch It is certified that error appears in the above-identified patent and that said Letters Patent is hereby corrected as shown below:

Title page,
Item [22], Filed: change "May 16, 2000" to -- January 17, 2000 --

Signed and Sealed this

Eighteenth Day of February, 2003

JAMES E. ROGAN
*Director of the United States Patent and Trademark Office*